US012276192B2

(12) United States Patent
Agostini et al.

(10) Patent No.: US 12,276,192 B2
(45) Date of Patent: Apr. 15, 2025

(54) SYSTEM AND METHOD FOR CONSTRUCTION AND COMPLETION OF PRODUCTION AND INJECTION WELLS IN THE PRE-SALT FIELDS

(71) Applicant: PETRÓLEO BRASILEIRO S.A.—PETROBRAS, Rio de Janeiro (BR)

(72) Inventors: Cristiano Eduardo Agostini, Santos (BR); Marcos Jun Tsuchie, Santos (BR); Marcos Vinicius Barreto Malfitani, Santos (BR); Reinaldo Akio Tomita, Santos (BR); Roger Savoldi Roman, Santos (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 0 days.

(21) Appl. No.: 18/391,032

(22) Filed: Dec. 20, 2023

(65) Prior Publication Data

US 2024/0209691 A1 Jun. 27, 2024

(30) Foreign Application Priority Data

Dec. 27, 2022 (BR) ..... 1020220266883

(51) Int. Cl.
*E21B 7/18* (2006.01)
*E21B 10/26* (2006.01)
*E21B 49/00* (2006.01)

(52) U.S. Cl.
CPC ..... *E21B 7/185* (2013.01); *E21B 10/26* (2013.01); *E21B 49/00* (2013.01)

(58) Field of Classification Search
CPC ..... E21B 7/185; E21B 10/26; E21B 49/00
See application file for complete search history.

(56) References Cited

U.S. PATENT DOCUMENTS

2017/0335649 A1* 11/2017 Hansen ..... E21B 19/08

FOREIGN PATENT DOCUMENTS

| | | | | |
|---|---|---|---|---|
| BR | 1120170064545 | A2 | 12/2017 | |
| BR | 1020180068644 | B1 | 10/2019 | |
| BR | 1020180676393 | A2 | 10/2020 | |
| CN | 114961555 | A | 8/2022 | |
| WO | 1999035368 | A1 | 7/1999 | |
| WO | WO-2019191827 | A1 * | 10/2019 | ..... E21B 23/00 |

* cited by examiner

*Primary Examiner* — James G Sayre
(74) *Attorney, Agent, or Firm* — Sterne, Kessler, Goldstein & Fox P.L.L.C.

(57) ABSTRACT

The present invention refers to a system and method for construction and completion of wells in the pre-salt production and injection fields. The application of the present invention allows a reduction in well construction time of approximately seven days considering the drilling and completion of the well. The system comprises string accessories, cement, AMB, production string, casings, HFIV, fluid, wellhead system, subsea equipment, DHSV and packer. The method aims at reducing one well phase, resulting in three drilling phases, with the running in of only two casings and the completion in an open well with part of the same exposed to the saline formation, herein called 2R-PAC.

14 Claims, 6 Drawing Sheets
(6 of 6 Drawing Sheet(s) Filed in Color)

SYSTEM AND METHOD FOR CONSTRUCTION AND COMPLETION OF PRODUCTION AND INJECTION WELLS IN THE PRE-SALT FIELDS

FIELD OF THE INVENTION

The present invention falls within the technical field of oil and gas, more specifically related to the drilling and completion of wells, and refers to a system and method for construction and completion of production and injection wells in pre-salt fields.

BACKGROUND OF THE INVENTION

The development of oil exploration projects is a challenge in fields where reservoir conditions are not good for production considering the high costs for construction of wells, subsea and surface facilities. The costs for constructing wells have been approximately 33% of the total cost of the project, which may become a restriction for economic implementation of the project. In this way, optimizing time and cost in the construction of wells demands new project concepts once the technical limit of a project is reached.

Typical and conventional systems and methods for drilling and completing pre-salt wells consist of four drilling phases with the running in of three or four casings, depending on the type of drilling and completion. In this type of project, the saline formations above the reservoir are isolated with the installation of two casings, one with a shoe positioned near the top of the formation and the other positioned at the base or inside the reservoir.

This configuration allows the drilling of most of the salt with return to the surface and use of adequate fluid, and the drilling of the reservoir without exposed saline formation, and the completion equipment is also not exposed to the saline formation.

In a slightly more detailed way, in the state of the art, the current concept of well drilling involves first drilling the well, which can be drilled with a drill bit or drill bit and reamer, subsequently running in a 30" (76.2 cm) or 36" (91.44 cm) conductive casing, or the beginning of a blasted well using a 30" (76.2 cm) or 36" (91.44 cm) conductive casing; this is the so-called Phase 1.

The phase is drilled until it enters the saline formation to position the casing shoe at a depth that allows safety and project criteria to be met for drilling the remainder of the saline formation in the next phase. In this phase, a casing is run in with tubes that can vary from 13⅝" (34.61 cm) to 22" (55.88 cm) depending on the diameter of the following phases; this is the so-called Phase 2.

The phase is then drilled until the reservoir is found to position a casing to cover the entire remainder of the saline formation and allow the next phase to drill only the reservoir. In this phase, the production casing is run in, with tubes that vary from 9⅝" (24.45 cm) to 11⅞" (30.16 cm), in the case in which phase 4 is not coated, or the intermediate casing is run in, with tubes that vary from 13⅜" (33.97 cm) to 14" (35.56 cm), in the case where phase 4 is coated; this is the so-called Phase 3.

The phase is drilled to the final depth and basically consists of drilling the reservoir, and the formation below when necessary. This phase may include the running in of a production casing with tubes that vary from 9⅝" (24.45 cm) to 11⅞" (30.16 cm) in the case of completion in a cased or uncased well, if the completion is done in an open well; this is the so-called Phase 4.

In the case of intelligent cased well completions, the completion consists of perforating the areas of interest followed by running in of the production string with its accessories. In the case of open well completion, the lower tail is run in and then the upper completion is run in, in a dedicated trip.

In view of this, and in order to solve the technical problem described previously, the present invention proposes the development of an optimized well drilling and completion system and method, wherein there can be noted a reduction in well construction time of approximately seven days considering the drilling and completion of the well, herein called the 2R-PAC system and method.

STATE OF THE ART

Document BR1020180068644 describes a method for constructing and completing an oil well with a Slender conception, consisting of four phases. In the specification, it is mentioned that a possible condensation of phases 3 and 4 into a single step would bring great agility to the process as a whole. Despite being a method similar to that of the present invention, the focus of the method described in said document is for specific types of wells, where drilling to the reservoir mainly comprises sandstone and shale formations, also comprising a sandstone reservoir. It is indicated in the specification that the invention is applied to sandstone or carbonate reservoirs.

Therefore, the simple application of the method described in the aforementioned document, without adapting the project in phase 2 for drilling the saline formation with an appropriately projected fluid, other than seawater, to guarantee drilling, casing running in and cementation, as well as adapting the completion equipment to be installed, and modifying the method and stimulation operational sequence, would not guarantee the success of the well construction in the pre-salt well environment. In this way, it is not possible to use the teachings of said document in the present invention.

In turn, document CN114961555A is part of the general state of the art and protects a well drilling construction method. According to the inventors, by combining various drilling devices and combining related mechanical parameters and construction process parameters, the drilling efficiency is effectively improved, the drilling period is greatly reduced, the cost is reduced.

Although the description mentions a broad application scenario, there is no applicability to oil wells located in deep (above 300 m) and ultra-deep (above 1500 m) water depths, such as in the pre-salt scenario, due to the need to position equipment on the ground, as well as mention of the construction of smaller holes than those used in offshore wells (in the offshore case, wells with diameters of up to 1060 mm are drilled, with holes of up to 500 mm being mentioned in the work). Therefore, the aforementioned document does not teach offshore drilling for the oil and gas industry, but rather onshore drilling with applications for buildings and water wells.

Document BR1020180676393, which is also part of the general state of the art, describes a well completion system capable of being installed in just one movement (single trip) and equipped with a means of sealing between the completion and a multiple valve actuation system that requires three ways to actuate the multiple valves. Thus, the aforementioned document refers to several specific completion equipment projects. Most of the projects presented have features or mechanisms that are alternative to equipment designs currently available on the market, but do not necessarily differ in functionality.

The method claimed by the present invention does not make specific use or functionality presented by the equipment in this document for its construction. That said, the present invention is simpler, as it does not require this equipment to be embodied.

Document WO1999035368A1 refers only to a method for drilling and completing a hydrocarbon production well. Compared to the present invention, it is considered to be a different method of well construction that consists of drilling and installing expandable casings, without the use of cement to provide hydraulic isolation and form part of the well structure.

It is a possible concept, but its applicability is restricted, due to the use of expandable casings that have lower mechanical strength, and the strength necessary for application in oil exploration wells in the pre-salt pole scenario. As an example, for a typical scenario of a water depth of 2000 m with a reservoir at a depth of around 5000 m with reservoir pressures of the order of 8000 to 9000 psi (55.158 a 62.053 MPa), they generate loads that exceed 6000 psi (41,367 MPa) of collapse pressure that these currently available expandable casings do not support.

Finally, document BR1120170064545 describes a completion system for drilled wells containing valve mechanisms, drives, sensors and devices capable of promoting safer, more efficient and, above all, more economically viable well exploration, according to the inventors. However, in said document, most of the systems and methods presented describe features or mechanisms that are alternative to equipment designs currently available on the market, but do not necessarily differ in functionality.

The method taught by the present invention does not make specific use or functionality presented by the document equipment for its construction. Thus, the present invention differs from this document, being simpler and more efficient.

In view of the disclosure above, it is noted that the present invention has a set of technical features aimed at application to the pre-salt, which aim at reducing one phase of the well, thus resulting in 3 (three) drilling phases, with the running in of only 2 (two) casings and completion in an open well with part of the same exposed to the saline formation (2R-PAC). These unexpected technical effects allow for a reduction in construction time and materials used to construct oil wells.

BRIEF DESCRIPTION OF THE INVENTION

The present invention refers to a system and method for constructing and completing wells in the pre-salt producing and injecting fields. The application of the present invention allows a reduction in well construction time of approximately seven days considering the drilling and completion of the well. The system comprises string accessories, cement, AMB, production string, casings, HFIV, fluid, wellhead system, subsea equipment, DHSV and packer. The method aims at reducing one well phase, resulting in three drilling phases, with the running in of only two casings and completion in an open well with part of the same exposed to the saline formation, herein called 2R-PAC.

BRIEF DESCRIPTION OF THE FIGURES

In order to complement the present description and obtain a better understanding of the features of the present invention, and in accordance with a preferred embodiment thereof, in the annex, a set of figures is presented, where in an exemplified, although not limiting, manner, its preferred embodiment is represented.

The patent or application file contains at least one drawing executed in color. Copies of this patent or patent application publication with color drawings will be provided by the Office upon request and payment of the necessary fee.

DETAILED DESCRIPTION OF THE INVENTION

Figure 6:
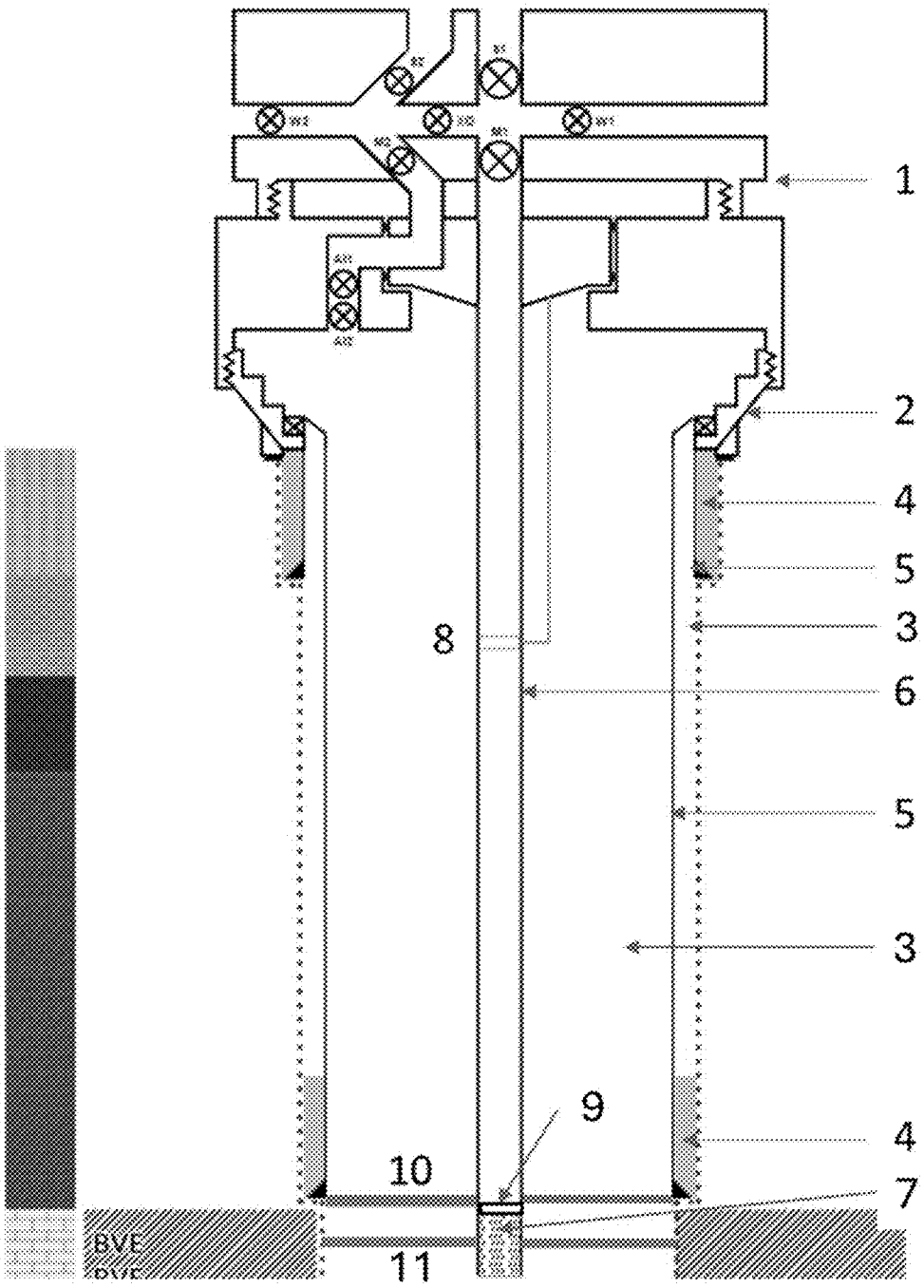
FIG. 6 represents a schematic drawing of the 2R-PAC system and method, highlighting each component, according to a preferred embodiment of the present invention.

The present invention refers to a system and method for constructing and completing wells in pre-salt producing and injecting fields. As shown in FIG. 6, the system comprises subsea equipment (1) (e.g. PAB and WCT which contains monitoring system and valves to enable well operation), wellhead media (2), drilling and completion fluid (3), cement (4), casings (5), production string (6), string accessories (7), DHSV (8), HFIV (9), Packer (10) and AMB (11).

Figure 1:
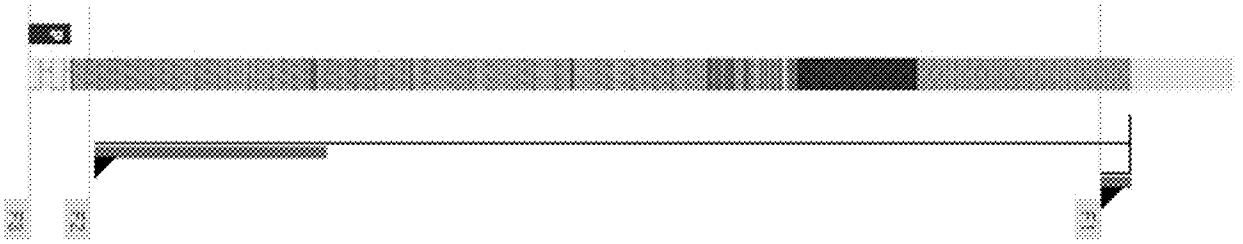
FIG. 1 represents a general diagram of well drilling with phases 1 (F1), 2 (F2) and 3 (F3), according to a preferred embodiment of the present invention.

These system and method, called 2R-PAC (2 Casing-Completed Open Well) reduces one phase of the well, thus resulting in 3 (three) drilling phases, with the running in of only 2 (two) casings and completion in an open well with part of the same exposed to the saline formation, as shown in FIG. 1. This allows a reduction in construction time, which also results in a reduction in the total cost of the well, thus reducing the costs of the well area for the project, improving its economy.

Figure 2:
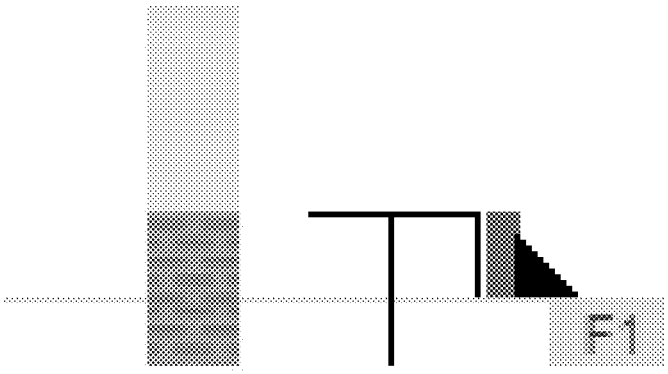
FIG. 2 represents a schematic drawing of Phase 1 (F1) of the 2R-PAC system and method, according to a preferred embodiment of the present invention.

As shown in FIG. 2, the method of the present invention begins (Phase 1 or F1) with the drilling with a drill bit or drill bit and reamer, subsequently running in a 30" (76.2 cm) or 36" (91.44 cm) conductive casing, or starting a blasted well with the use of 30" (76.2 cm) or 36" (91.44 cm) conductive casing, with open sea setting string and cementing until the seabed of the casing, in both cases using seawater and drilling fluid. This casing must provide structural support for the remainder of the productive life of the well.

Figure 3:
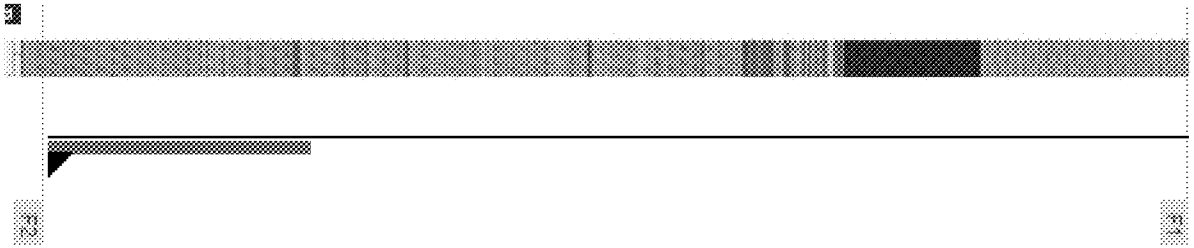
FIG. 3 represents a schematic drawing of Phase 2 (F2) of the 2R-PAC system and method, according to a preferred embodiment of the present invention.

As shown in FIG. 3, in Phase 2 or F2, the phase is drilled with a drill bit using seawater and water-based drilling fluid until close to the base of the saline formation, maintaining a minimum distance above the reservoir, considering the uncertainties of seismic, string length, minimum extent of sealing formation, etc., to avoid the risk of leakage to the seabed, as there is still no BOP installed at this step.

The positioning of this shoe must be able to withstand the reservoir pressure in the next phase considering that the well may be full of reservoir fluid. The strategy of drilling with seawater and drilling fluids, and composition of the drilling fluids, is projected and suitable for the location in order to prevent formation breakout.

RMR (Riserless Mud Recovery) technology can also be used at this phase. At this phase, a production casing is run in with pipes that can vary from 9⅝" (24.45 cm) to 14" (35.56 cm) depending on the diameter of the completion string, which can vary from 4½" (11.43 cm) to 9⅝" (24.45 cm) depending on the project requirement.

Figure 4:
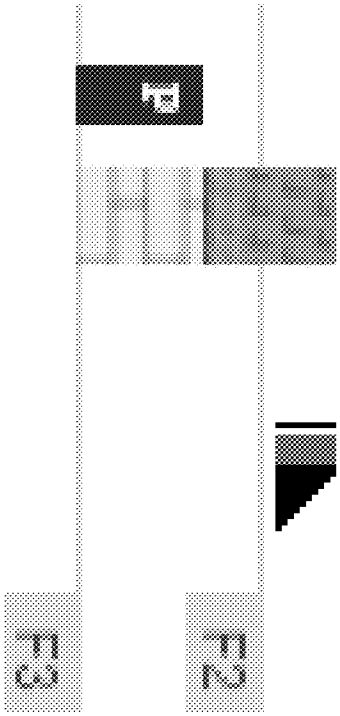
FIG. 4 represents a schematic drawing of Phase 3 (F3) of the 2R-PAC system and method, according to a preferred embodiment of the present invention.
Figure 5:
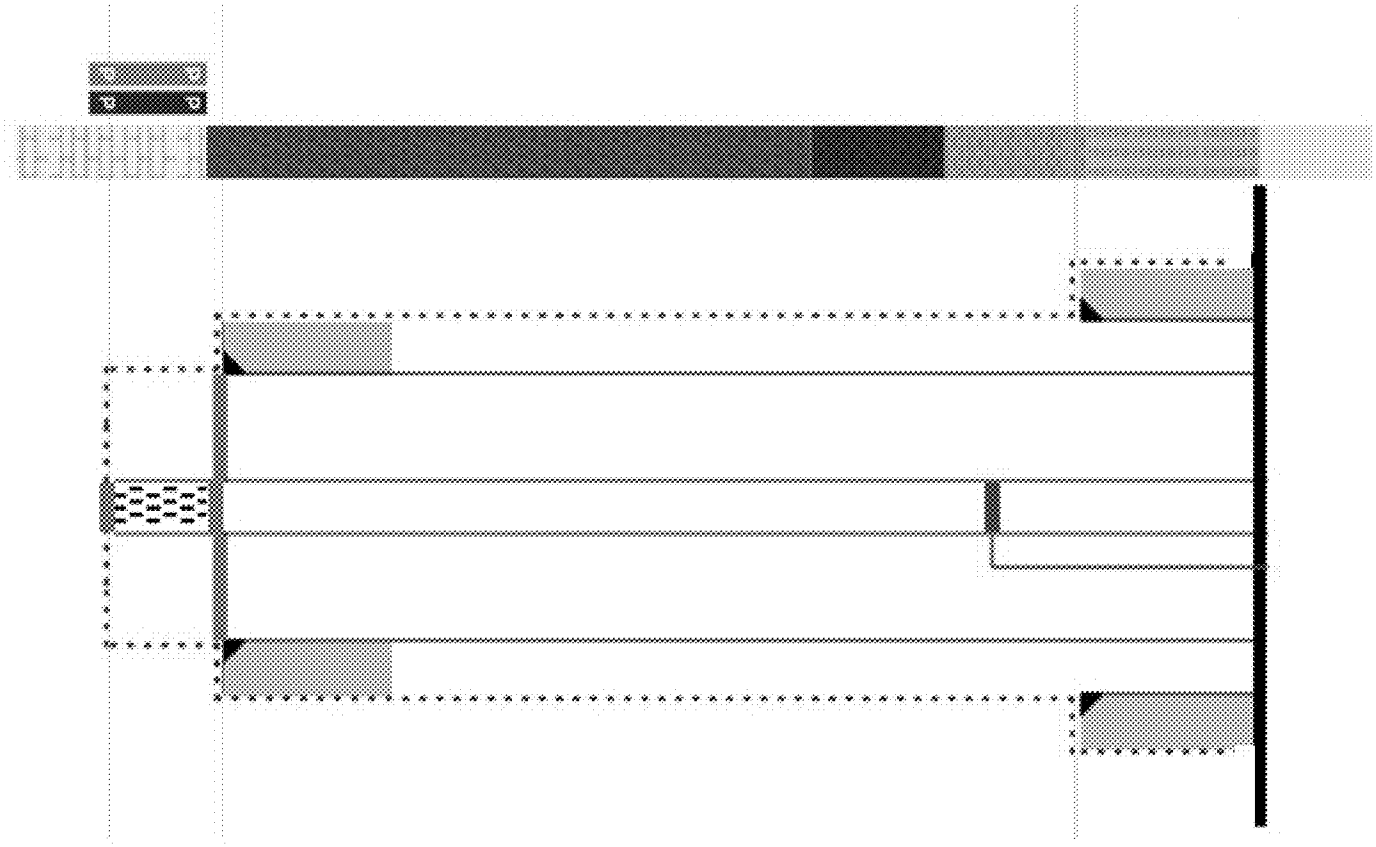
FIG. 5 represents a schematic drawing of the completion string of the associated 2R-PAC system and method, according to a preferred embodiment of the present invention.

As shown in FIG. 4, in Phase 3 or F3, the phase is drilled until the final programmed depth of the well, drilling the remainder of the saline formation and the reservoir with synthetic- or water-based fluid with adequate formulation and salinity to avoid the dissolution of the salt. At the end of the phase, wireline logging may occur to acquire reservoir data, as well as fluid exchange may be necessary, if there is incompatibility of the completion equipment and stimulation system with the drilling fluid to be used. In the 2R-PAC conception, the casing is not run in and, the completion is carried out in an open well.

The installation of the lower completion, in this scenario, has an additional function, in addition to allowing the production of fluid from the reservoir or injection of water or gas, of isolating the saline formations from the production or injection flow that will be exposed in phase 3; therefore, elements of the tail in front of the salt must withstand the forces arising from its creep.

In addition, there may be unfavorable geometric conditions for the passage of the lower completion due to intercalations in the saline formation; in this way, the lower tail equipment is designed and chosen in order to minimize the risks of bumping, including considering the possibility of carrying out the string rotation to facilitate the running in of equipment.

The interface between the base of the saline formation and the top of the reservoir also configures a point of transition of properties, with potential generation of stop. Due to the exposed saline section, the running in of the lower tail may be in a synthetic fluid environment; therefore, the stimulation and fluid exchange strategy for the scenario shall consider the pumping of cushions and compatible acids to stimulate the formation. Thus, it is noted that the 2R-PAC concept allows the production casing section to be 11⅞" (30.16 cm) and, thus, the production string section can be 7⅝" (19.37 cm).

Chronological Description of the Well Construction Steps

The 2R-PAC well conception occurs by constructing the well, following the following macro steps of the process: 1. Drilling with a 36" (91.44 cm) or 42" (106.68 cm) drill bit and drill string using seawater and drilling fluid. 2. Installation of 30" (76.2 cm) or 36" (91.44 cm) conductive casing with open sea laying string and cementing to the seabed of the casing. 3. Drilling with a 12¼" (31.12 cm) or 14¾" (37.47 cm) drill bit of post-salt and salt with seawater and drilling fluid until the final depth of the phase.

The times for using the drilling fluid are defined based on the features of each well, and it is necessarily used in the last 500 m of the phase to preserve the quality of the well for running in of the casing and casing cementation. 4. Installation of the 9⅝" (24.45 cm) or 10¾" (27.31 cm) or 11⅞" (30.16 cm) production casing with open sea setting string and cementing of the casing in footage designed to establish the joint sets of barriers necessary for the remainder of its life well productivity.

5. Installation of the PAB (Production Adapter Base) at the wellhead with SESV (Subsea Equipment Support Vessel) 6. Installation and testing of the BOP (Blow-out Preventer) at the PAB. 7. Drilling with an 8½" (21.59 cm) drill bit from the salt and reservoir with drilling fluid (water-based or synthetic) until the final depth of the well. 8. Exchange of drilling fluid for completion fluid. 9. Assembly of the lower completion tail. 10. Running in the lower tail assembly with string to the setting position.

11. Pre-stimulation of the reservoir through the positioning of cushions and acids by circulation or direct injection (bullheading) into the reservoir (design and composition of acids and cushions according to the features of each reservoir). 12. Setting of the packer seal bore and AMBs (Annular Mechanical Barriers).

13. Stimulation of the reservoir by pumping cushions and acids by direct injection (bullheading) into the reservoir (design and composition of acids and cushions according to the features of each reservoir). 14. Closing the FIV valve and removing the lower tail installation tool. 15. Withdrawal of Wear Bushing (WB) from PAB.

16. Assembling the upper completion string 17. Running in of the upper completion with DPR (Drill Pipe Riser). 18. Setting of the TH (tubing hanger) and carrying out pressure tests to ensure equipment integrity. 19. Reservoir stimulation. 20. Prevention of hydrates in the WCT and string with MEG and/or diesel positioning to a position below the DHSV. 21. Closure of DHSV. 22. Withdrawal of the TH installation tool. 23. Disconnection and withdrawal of the BOP. 24. Installation of WCT (Wet Christmas Tree) with SESV.

The components and their respective position in the lower or upper completion may vary according to the objectives of each well, such as, well function (producer or injector), presence and quantity of ICV valves, gas lift mandrels and chemical injection, PDGs, DHSV, among others.

With the application of this system and method, compared to the application of the typical system and method, there is a reduction in well construction time of approximately seven days considering the drilling and completion of the well. Other gains in the configuration are not needing a "drill through" wellhead system, which is a limited resource in wells, taking advantage of the optimization of the PAB installation combined with SESV even during the running in of the BOP from the probe (out of the way critical). Furthermore, the well has no pack-off (CVU), presenting less restriction on the production loads of the well.

Those skilled in the art will value the knowledge presented herein and will be able to reproduce the invention in the presented embodiments and in other variants, encompassed by the scope of the attached claims.

What is claimed is:

1. A method for construction and completion of production and injection wells in pre-salt fields, wherein the method comprises three drilling phases with the running in of two casings, the method comprising:

a first drilling phase comprising drilling with a drill bit or a drill bit and a reamer, and subsequently running in a conductive casing with a diameter of 30" (76.2 cm) or 36" (91.44 cm);

a second drilling phase comprising drilling with a drill bit and water based fluids until close to the base of a saline formation, maintaining a minimum distance above a reservoir; wherein the second drilling phase includes drilling with a first drilling fluid and a second drilling fluid that is different than the first drilling fluid, wherein the first drilling fluid is seawater;

a third drilling phase comprising drilling to a final programmed depth of a well, drilling the remainder of the saline formation; and completing the well.

2. The method according to claim 1, wherein seawater and a drilling fluid are used in the first drilling phase.

3. The method according to claim 1, wherein the conductive casing is configured as a structural support.

4. The method according to claim 1, wherein a production casing is run in with tubes in the second drilling phase, wherein the tubes have a diameter from 9⅝" (24.45 cm) to 14" (35.56 cm) or from 4½" (11.43 cm) to 9⅝" (24.45 cm).

5. The method according to claim 1, further comprising wireline logging to acquire reservoir data after drilling to a final programmed depth.

6. The method according to claim 1, further comprising a fluid exchange after drilling to a final programmed depth, wherein the fluid exchange occurs if there is incompatibility of completion equipment and a stimulation system with the drilling fluid.

7. The method according to claim 1, wherein a production casing has a diameter of 11⅞" (30.16 cm) and the section of a production string has a diameter of 7⅝" (19.37 cm).

8. The method of claim 1, wherein a third drilling fluid of the third drilling phase comprises at least one of a synthetic fluid or water based fluid with adequate formulation and salinity to avoid the dissolution of salt.

9. The method of claim 8, further comprising exchanging the water based or synthetic drilling fluid of the third drilling phase for completion fluid after completing the third drilling phase.

10. The method of claim 1, wherein the second drilling fluid is not seawater.

11. The method of claim 1, wherein completion is carried out in an open well.

12. The method of claim 1, wherein the first drilling phase and the second drilling phase do not include installation and testing of a Blow-out Preventer (BOP).

13. The method of claim 1, wherein a lower completion is installed during the third drilling phase, and wherein the lower completion is configured to:

isolate saline formations from production or injection flow, and guide fluid from the reservoir or guide injected water or gas.

14. The method of claim 1, wherein the completed well comprises an exposed saline section.

* * * * *